US006821186B1

(12) United States Patent
James

(10) Patent No.: US 6,821,186 B1
(45) Date of Patent: Nov. 23, 2004

(54) SYSTEM FOR REPAIRING A BRASSIERE

(76) Inventor: Sylvia James, 6330 Anderson St., Philadelphia, PA (US) 19138

( * ) Notice: Subject to any disclaimer, the term of this patent is extended or adjusted under 35 U.S.C. 154(b) by 0 days.

(21) Appl. No.: 10/436,493

(22) Filed: May 12, 2003

(51) Int. Cl.[7] ..... A41F 1/00
(52) U.S. Cl. ..... 450/86; 24/312; 2/336
(58) Field of Search ..... 450/86, 88, 128; 24/312, 313, 198, 200, 167, 310, 311, 170, 191, 193, 197; 2/336, 310, 321, 322, 333

(56) References Cited

U.S. PATENT DOCUMENTS 899,670 A * 9/1908 Hyde, Jr. ..... 24/198
1,478,658 A * 12/1923 King ..... 24/198
2,123,773 A * 7/1938 Eppink ..... 24/198
3,121,270 A * 2/1964 Van Den Broek et al. .... 24/198
4,038,726 A * 8/1977 Takabayashi ..... 24/198
4,400,855 A * 8/1983 Stuart ..... 24/200
5,600,875 A * 2/1997 Chang ..... 24/200
5,911,618 A * 6/1999 Dailey ..... 450/86
6,368,180 B1 * 4/2002 Dailey ..... 450/86
6,539,592 B1 * 4/2003 Choi et al. ..... 24/197

* cited by examiner

*Primary Examiner*—Gloria M. Hale

(57) ABSTRACT

A system for repairing a brassiere for extending the service life on intimate apparel by replacing broken connective components. The the system for repairing a brassiere includes at least one connecting ring assembly for coupling a shoulder strap to a main portion of a brassiere, and at least one length adjusting assembly positionable on the shoulder strap and couplable to an end of the strap. The length adjusting assembly facilitates slidably adjusting a net length of a shoulder strap.

17 Claims, 4 Drawing Sheets

SYSTEM FOR REPAIRING A BRASSIERE

BACKGROUND OF THE INVENTION

1. Field of the Invention

The present invention relates to clothing repair systems and more particularly pertains to a new the system for repairing a brassiere for extending the service life on intimate apparel by replacing broken connective components.

2. Description of the Prior Art

The use of clothing repair systems is known in the prior art. U.S. Pat. No. 5,911,618 describes a system using spring loaded connections for the ring member and buckle member (length adjusting member) Another type of clothing repair systems is U.S. Pat. No. 6,056,625 having a recessed cross-bar.

While these devices fulfill their respective, particular objectives and requirements, the need remains for a system that is superior in providing a simple, dependable, and secure repair system for the plastic components on intimate apparel which break from time to time.

SUMMARY OF THE INVENTION

The present invention meets the needs presented above by providing simple snap together components which are easily assembled, with a minimum of moving parts.

Another object of the present invention is to provide a new the system for repairing a brassiere that will not rust.

To this end, the present invention generally comprises at least one connecting ring assembly for coupling a shoulder strap to a main portion of a brassiere, and at least one length adjusting assembly positionable on the shoulder strap and couplable to an end of the strap. The length adjusting assembly facilitates slidably adjusting a net length of a shoulder strap.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
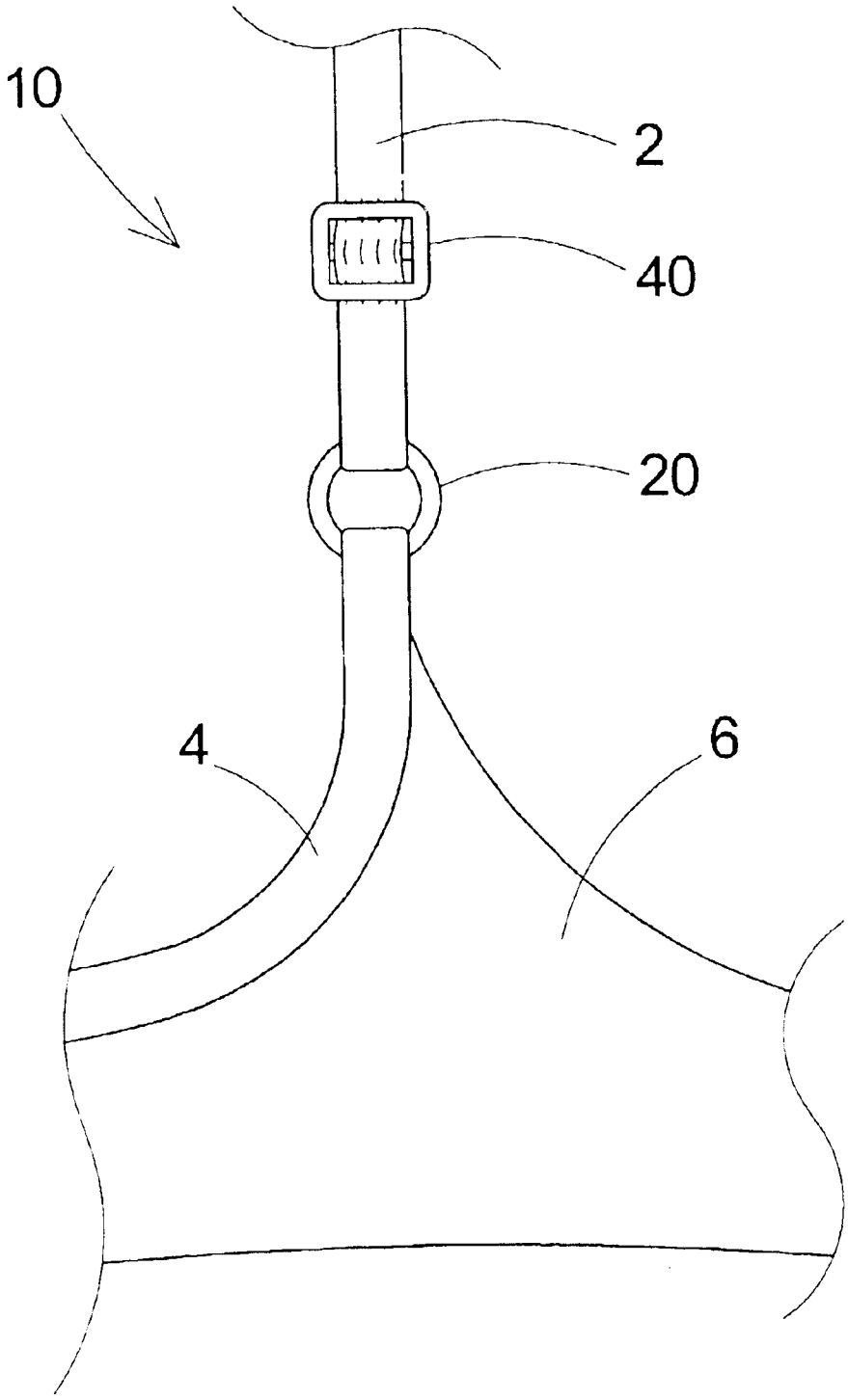
FIG. 1 is a schematic front view of a new the system for repairing a brassiere according to the present invention.
Figure 2:
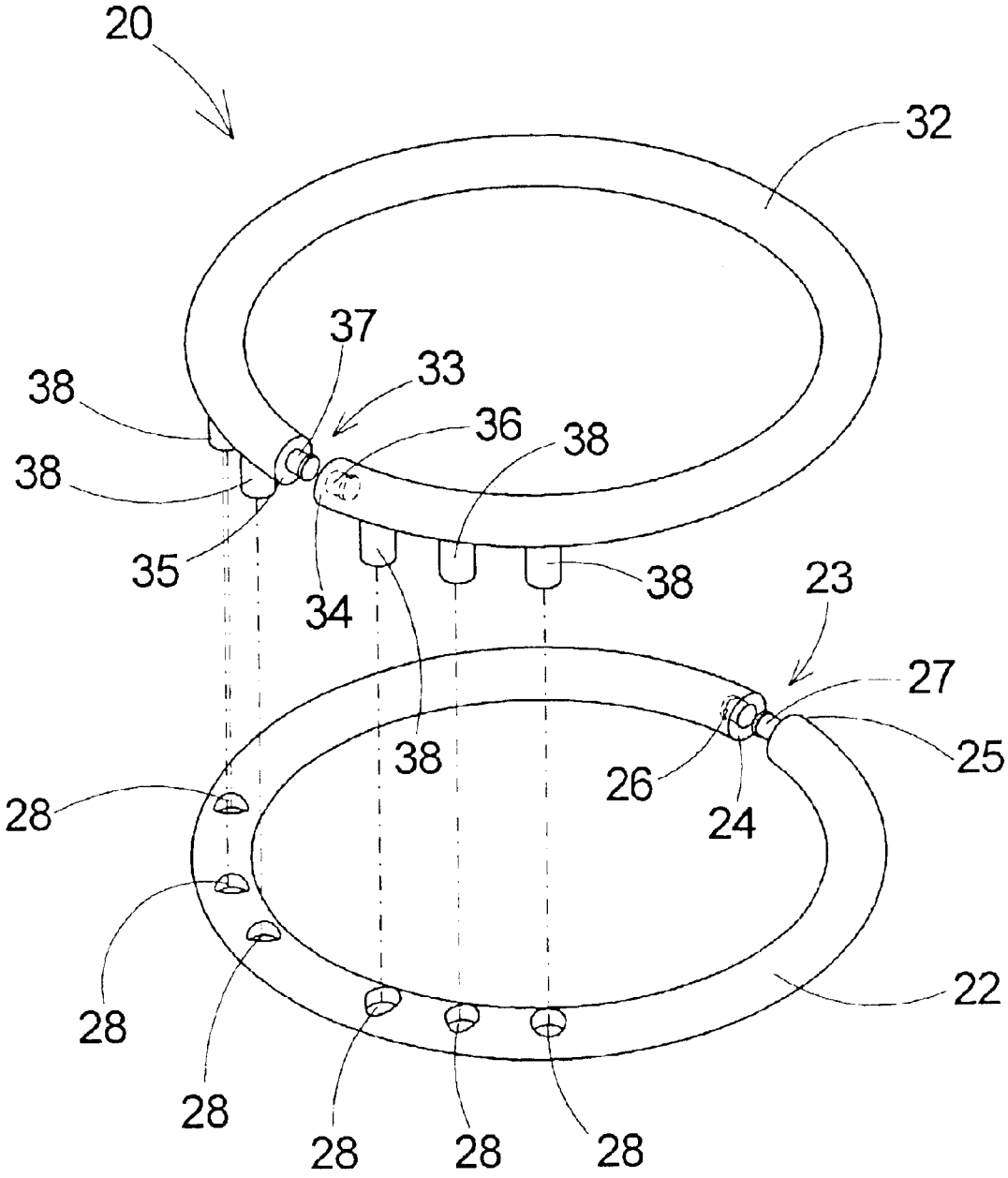
FIG. 2 is a schematic perspective view of the connecting ring assembly of the present invention.
Figure 3:
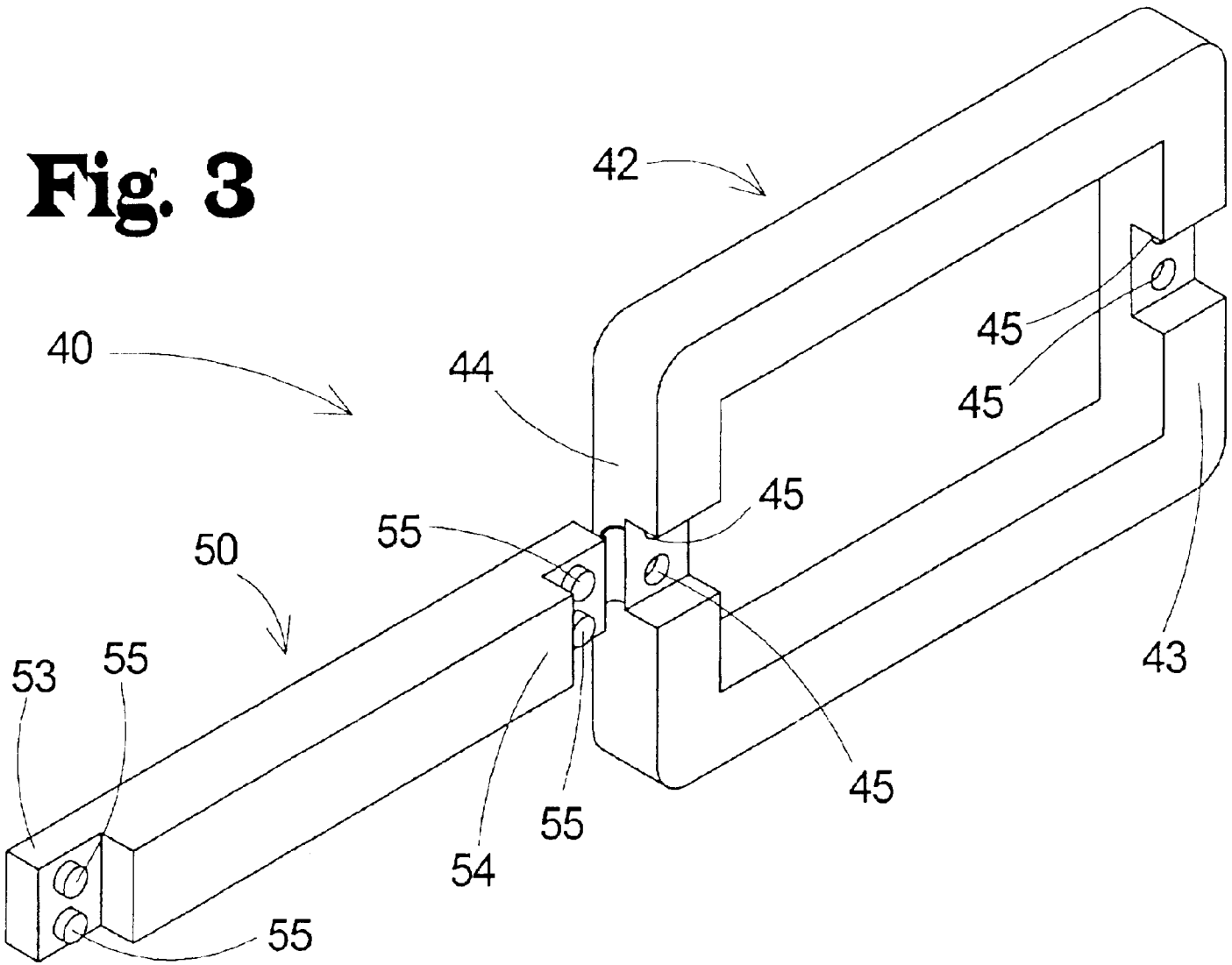
FIG. 3 is a schematic perspective view of the length adjusting assembly present invention.
Figure 4:
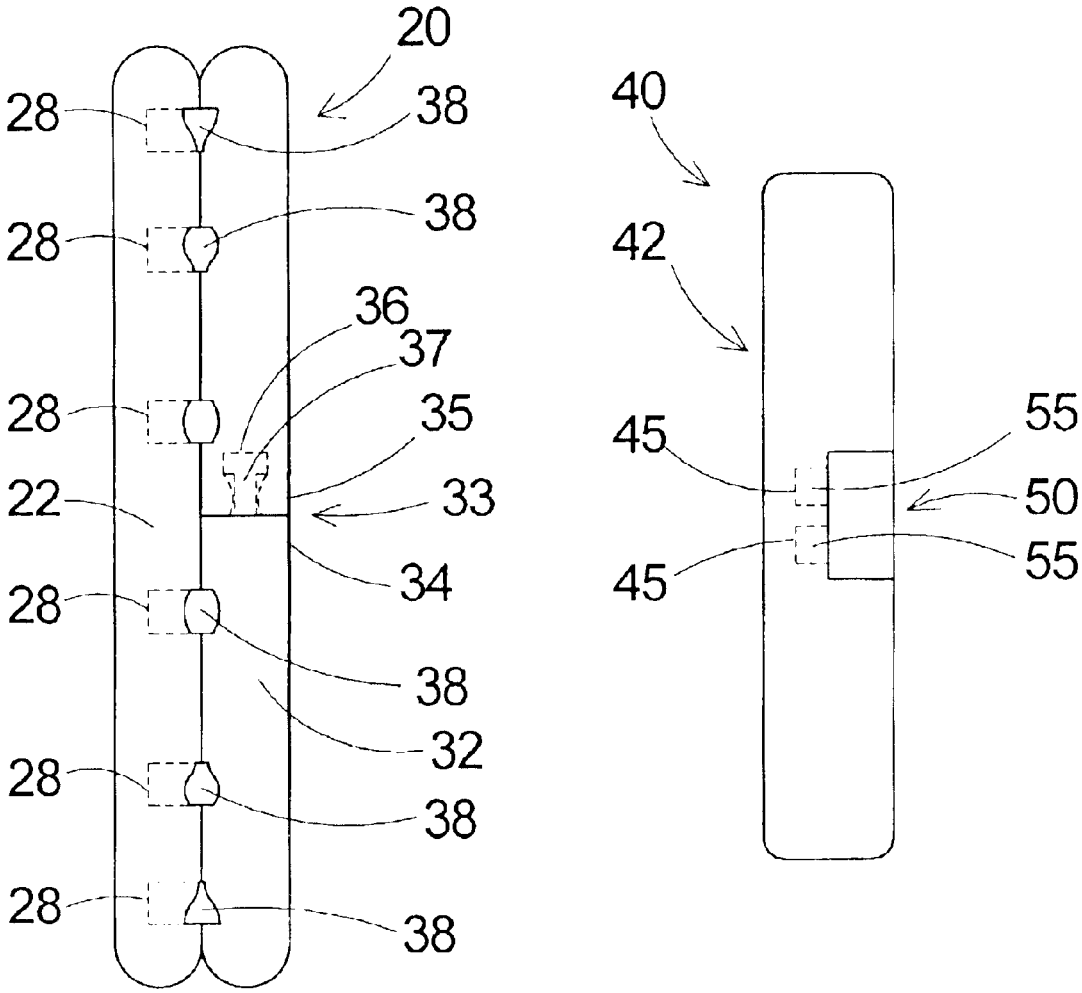
FIG. 4 is a schematic front view of the present invention.

With reference now to the drawings, and in particular to FIGS. 1 through 4 thereof, a new the system for repairing a brassiere embodying the principles and concepts of the present invention and generally designated by the reference numeral 10 will be described.

As best illustrated in FIGS. 1 through 4, the the system for repairing a brassiere 10 generally comprises at least one connecting ring assembly 20 for operationally coupling a shoulder strap 2 to a main portion 4 of a brassiere 6, and at least one length adjusting assembly 40 positionable on the shoulder strap 2 and couplable to an end of the strap 2. The length adjusting assembly 40 facilitates slidably adjusting a net length of a shoulder strap 2.

In an embodiment the ring assembly 20 further comprises a first 22 and a second annulus member 32.

The first annulus member 22 includes a first break 23 therein. The first annulus member 22 also includes a first end 24 and a second end 25 positioned on either side of the first break 23. The first end 24 includes a first bore 26 extending therein. 2 second end 25 includes a first tab portion 27. The first tab portion 27 is slideably receivable in the first bore 26 for selectively closing the first annulus member 22.

Similarly, the second annulus member 32 also includes a second break 33, a third end 34 and a fourth end 35 positioned on either side of the second break 33. The third end 34 includes a second bore 36 extending therein. The fourth end 35 includes a second tab portion 37. The second tab portion 37 is slidably receivable in the second bore 36 for selectively closing the second annulus member 32.

In an embodiment the first annulus member 22 includes a plurality of bores 28 extending into the first 24 and second ends 25. The second annulus member 32 includes a plurality of pin members 38 extending outwardly from a medial portion of the second annulus member 32. Each one of the pin members 38 is slideably receivable in an associated one of the bores 28. Thus, the first annulus member 22 is selectively couplable to the second annulus member 32 with the first break 23 being positioned opposite of the second break 33. This configuration not only increases the strength of the connecting ring assembly 20, but also inhibits the first 22 and second annulus members 32 from inadvertently opening and releasing the shoulder strap 2.

In an embodiment the length adjusting assembly 40 further comprises a ring member 42 and a bar member 50. The ring member 42 includes a right side 43 and a left side 44. The right 42 and left sides 43 each include at least one bore 45 extending therein. The bar member 50 includes a bar right side 53 and a bar left side 54. The bar member includes at least a pair of tab members 55. Each one of the tab members 55 is positioned on an associated one of the bar right side 53 and bar left side 54. The bar member 50 is for slideably receiving a loop on an end of the shoulder strap 2. The shoulder strap 2 runs from the bar member 50 through the connecting ring assembly 20 and through the length adjusting assembly 40 to a main portion 4 of the brassiere 6. The bar member 50 is selectively positionable across the ring member 42.

In a preferred embodiment the bar member 50 is pivotally coupled to the ring member 42.

In use, the system is utilized to replace a broken length adjuster or strap connector of a brassiere. If the component to be replaced has not been removed from the brassiere, to may be cut off by the user. In the case of replacing a broken length adjuster, the looped end of the brassiere strap is placed over the bar member 50. The distal side of the strap (the portion extending through the strap connector) is then positioned between the ring member 42 and the bar member 50. The bar member 50 is then pivoted towards the ring member and the bar member 50 is snapped into position abutting the ring member 42 with the tab member 55 being seated into the associated bores 45. Additionally, in the case of replacing a broken strap connector, the user inserts the looped end of the strap onto the first annulus member 22 through the first break 23. Similarly, the loop extending from the main portion of the brassiere is also inserted onto the first annulus member through the first break 23. The first tab portion 27 is then inserted into the first bore 26, effectively closing the first break 23. In the same manner the looped end of the strap and the loop extending from the main portion of the brassiere are also inserted onto the second annulus member 32 utilizing the second break 33. The second break 33 is then effectively closed by inserting the second tab portion 37 in to the second bore 36. The second annulus member is rotated with respect to the first annulus member so that the first break and the second break are not aligned. The second annulus member is then engaged with first annulus member by seating the plurality of pin members 38 into their associated bores 28 to inhibit the connecting ring assembly 20 from opening inadvertently.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to, those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system for the repair of a brassiere comprising:

at least one connecting ring assembly for operationally coupling a shoulder strap to a main portion of a brassiere;

at least one length adjusting assembly positionable on the shoulder strap and couplable to an end of the strap, said length adjusting assembly facilitating slidably adjusting a net length of a shoulder strap;

wherein said ring assembly further comprises:

a first annulus member having a first break therein said first annulus member having a first end aid a second end positioned on either side of said first break, said second end having a first bore extending therein, said first end having a first tab portion, said first tab portion being slideably receivable in said first bore for selectively closing said first annulus member;

a second annulus member having a second break therein, said second annulus member having third end and a fourth end positioned on either side of said second break, said fourth end having second bore extending therein, said third end having a second tab portion said second tab portion being slideably receivable in said second bore for selectively closing said second annulus member; and wherein said first annulus member having a plurality of bores extending into said first and second ends; said second annulus member having a plurality of pin members extending outwardly from a medial portion of said second annulus member each one of said pin members being slideably receivable in an associated one of said bores whereby said first annulus member is selectively couplable to said second annulus member with said first break being positioned opposite of said second break.

2. The system of claim 1, wherein said length adjusting assembly further comprises a ring member and a bar member, said ring member having a right side and a left side, said right and left sides having at least one bore extending therein, said bar member having a bar right side and a bar left side, said bar member having at least a pair of tab members, each one of said tab members being positioned on an associated one of said bar right side and bar left side, said bar member being for slideably receiving a loop on an end of the shoulder strap, the shoulder strap running from the bar member through said connecting ring and through said length adjusting assembly to a main portion of the brassiere, the bar member being selectively positionable across said ring member.

3. The system of claim 2, wherein said bar member being pivotally coupled to said ring member.

4. A system for repair of a brassiere comprising:

member having a plurality of bores extending into said first and second ends; said first annulus member having a plurality of pin members extending outwardly from a medial portion of said second annulus member, each one of said pin members being slideably receivable in an associated one of said bores whereby said first annulus member is selectively couplable to said second annulus member with said first break being positioned opposite of said second break.

5. The system of claim 1, wherein said length adjusting assembly further comprises a ring member and a bar member, said ring member having a right side and a left side, said right and left sides having at least one tab extending therefrom, said bar member having a bar right side and a bar left side, said bar member having at least a pair of bores extending therein, each one of said bores being positioned on an associated one of said bar right side and bar left side, said bar member being for slideably receiving a loop on an end of the shoulder strap, the shoulder strap running from the bar member through said connecting ring and through said length adjusting assembly to a main portion of the brassiere, the bar member being selectively positionable across said ring member.

6. The system of claim 5, wherein said bar member being pivotally coupled to said ring member.

7. A system for the repair of a brassiere comprising:

at least one connecting ring assembly for operationally coupling a shoulder strap to a main portion of a brassiere;

at least one length adjusting assembly positionable on the shoulder strap and couplable to an end of the strap, said length adjusting assembly facilitating slidably adjusting a net length of a shoulder strap; and wherein said length adjusting assembly further comprises a ring member and a bar member, said ring member having a right side and a left side, said right and left sides having at least one bore extending therein, said bar member having a bar right side and a bar left side, said bar member having at least a pair of tab members, each one of said tab members being positioned on an associated one of said bar right side and bar left side, said bar member being for slideably receiving a loop on an end of the shoulder strap, the shoulder strap running from the bar member through said connecting ring and through said length adjusting assembly to a main portion of the brassiere, the bar member being selectively positionable across said ring member.

8. The system of claim 7, wherein said ring assembly comprises an annulus member having a break therein, said annulus member having a first end and a second end positioned on either side of said break, said second end having a bore extending therein, said first end having a tab portion, said tab portion being slideably receivable in said bore for selectively closing said annulus member.

9. The system of claim 7, wherein said ring assembly further comprises:

a first annulus member having a first break therein, said first annulus member having a first end and a second end positioned on either side of said first break, said second end having a first bore extending therein, said first end having a first tab portion, said first tab portion being slideably receivable in said first bore for selectively closing said first annulus member; and a second annulus member having a second break therein, said second annulus member having a third end and a fourth end positioned on either side of said second break, said fourth end having a second bore extending therein, said third end having a second tab portion, said second tab portion being slideably receivable in said second bore for selectively closing said second annulus member.

10. The system of claim 7, wherein said ring assembly comprises an annulus member having a break therein, said annulus member having a first end and a second end positioned on either side of said break, said second end having a tab portion extending therefrom, said first end having a bore extending therein, said tab portion being slideably receivable in said bore for selectively closing said annulus member.

11. The system of claim 7, wherein said length adjusting assembly further comprises a ring member and a bar member, said ring member having a right side and a left side, said right and left sides having at least one tab extending therefrom, said bar member having a bar right side and a bar left side, said bar member having at least a pair of bores extending therein, each one of said bores being positioned on an associated one of said bar right side and bar left side, said bar member being for slideably receiving a loop on an end of the shoulder strap, the shoulder strap running from the bar member through said connecting ring and through said length adjusting assembly to a main portion of the brassiere, the bar member being selectively positionable across said ring member.

12. A system for the repair of a brassiere comprising:

at least one connecting ring assembly for operationally coupling a shoulder strap to a main portion of a brassiere;

at least one length adjusting assembly positionable on the shoulder strap and couplable to an end of the strap, said length adjusting assembly facilitating slidably adjusting a net length of a shoulder strap; and wherein said length adjusting assembly further comprises a ring member and a bar member, said ring member having a right side and a left side, said right and left sides having at least one tab extending therefrom, said bar member having a bar right side and a bar left side, said bar member having at least a pair of bores extending therein, each one of said bores being positioned on an associated one of said bar right side and bar left side, said bar member being for slideably receiving a loop on an end of the shoulder strap, the shoulder strap running from the bar member through said connecting ring and through said length adjusting assembly to a main portion of the brassiere, the bar member being selectively positionable across said ring member.

13. The system of claim 12, wherein said ring assembly comprises an annulus member having a break therein, said annulus member having a first end and a second end positioned on either side of said break, said second end having a bore extending therein, said first end having a tab portion, said tab portion being slideably receivable in said bore for selectively closing said annulus member.

14. The system of claim 12, wherein said ring assembly further comprises:

a first annulus member having a first break therein, said first annulus member having a first end and a second end positioned on either side of said first break, said second end having a first bore extending therein, said first end having a first tab portion, said first tab portion being slideably receivable in said first bore for selectively closing said first annulus member; and a second annulus member having a second break therein, said second annulus member having a third end and a fourth end positioned on either side of said second break, said fourth end having a second bore extending therein, said third end having a second tab portion, said second tab portion being slideably receivable in said second bore for selectively closing said second annulus member.

15. The system of claim 12, wherein said ring assembly comprises an annulus member having a break therein, said annulus member having a first end and a second end positioned on either side of said break, said second cad having a tab portion extending therefrom, said first end having a bore extending therein, said tab portion being slideably receivable in said bore for selectively closing said annulus member.

16. The system of claim 12, wherein said ring assembly further comprises:

a first annulus member having a first break therein, said first annulus member having a first end and a second end positioned on either side of said first break, said second end having a first tab portion extending therefrom, said first end having a first bore, said first tab portion being slideably receivable in said first bore for selectively closing said first annulus member; and a second annulus member having a second break therein, said second annulus member having a third end and a fourth end positioned on either side of said second break, said fourth end having a second tab portion extending therefrom, said third end having a second bore extending therein, said second tab portion being slideably receivable in said second bore for selectively closing said second annulus member.

17. The system of claim 1, further comprising:

wherein said ring assembly further comprises:

a first annulus member having a first break therein, said first annulus member having a first end and a second end positioned on either side of said first break, said second end having a first bore extending therein, said first end having a first tab portion, said first tab portion being slideably receivable in said first bore for selectively closing said first annulus member; and a second annulus member having a second break therein, said second annulus member having a third end and a fourth end positioned on either side of said second break, said fourth end having a second bore extending therein, said third end having a second tab portion, said second tab portion being slideably receivable in said second bore for selectively closing said second annulus member;

wherein said first annulus member having a plurality of bores extending into said first and second ends; said second annulus member having a plurality of pin members extending outwardly from a medial portion of said second annulus member, each one of said pin members being slideably receivable in an associated one of said bores whereby said first annulus member is selectively couplable to said second annulus member with said first break being positioned opposite of said second break;

wherein said length adjusting assembly further comprises a ring member and a bar member, said ring member having a right side and a left side, said right and left sides having at least one bore extending therein, said bar member having a bar right side and a bar left side, said bar member having at least a pair of tab members, each one of said tab members being positioned on an associated one of said bar right side and bar left side, said bar member being for slideably receiving a loop on an end of the shoulder strap, the shoulder strap running from the bar member through said connecting ring and through said length adjusting assembly to a main portion of the brassiere, the bar member being selectively positionable across said ring member; and wherein said bar member being pivotally coupled to said ring member.

* * * * *